US012723370B2

(12) United States Patent
Kim

(10) Patent No.: US 12,723,370 B2
(45) Date of Patent: Sep. 1, 2026

(54) START CONTROL SYSTEM FOR CONSTRUCTION MACHINE, AND CONTROL METHOD THEREOF

(71) Applicant: HD CONSTRUCTION EQUIPMENT CO., LTD., Seongnam-si (KR)

(72) Inventor: Jihoon Kim, Seoul (KR)

(73) Assignee: HD CONSTRUCTION EQUIPMENT CO., LTD., Seongnam-si (KR)

( * ) Notice: Subject to any disclaimer, the term of this patent is extended or adjusted under 35 U.S.C. 154(b) by 0 days.

(21) Appl. No.: 18/850,269

(22) PCT Filed: Mar. 23, 2023

(86) PCT No.: PCT/KR2023/003893

§ 371 (c)(1),
(2) Date: Sep. 24, 2024

(87) PCT Pub. No.: WO2023/182843

PCT Pub. Date: Sep. 28, 2023

(65) Prior Publication Data

US 2025/0207362 A1 Jun. 26, 2025

(30) Foreign Application Priority Data

Mar. 24, 2022 (KR) ..... 10-2022-0036791

(51) Int. Cl.
*E02F 9/20* (2006.01)
*E02F 9/22* (2006.01)

(52) U.S. Cl.
CPC ..... *E02F 9/2095* (2013.01); *E02F 9/2278* (2013.01)

(58) Field of Classification Search
None
See application file for complete search history.

(56) References Cited

U.S. PATENT DOCUMENTS

2005/0209758 A1 9/2005 Kim
2017/0197622 A1* 7/2017 Books ..... B60K 6/20
(Continued)

FOREIGN PATENT DOCUMENTS

JP H5-25972 A 2/1993
JP 2000-8422 A 1/2000
(Continued)

OTHER PUBLICATIONS

International Search Report issued on Jul. 11, 2023 for corresponding International Patent Application No. PCT/KR2023/003893, along with an English translation (5 pages).
(Continued)

*Primary Examiner* — Anshul Sood
(74) *Attorney, Agent, or Firm* — Hauptman Ham, LLP

(57) ABSTRACT

The present disclosure relates to a start control system for a construction machine, and a control method thereof, the system comprising: a work device and a travel device of the construction machine, the work device and travel device being mechanically connected to an engine; a start switch controller which receives a signal input to a start switch and converts the start of the engine to an on/off state; and a vehicle control unit which receives information from the work device and the travel device, determines whether the construction machine is working or traveling, and transmits a signal to the start switch controller, wherein, when the vehicle control unit which has determined that the construction machine is working or traveling transmits the signal, the start switch controller determines that the signal input to the start switch is a noise signal and maintains a start state of the construction machine.

10 Claims, 2 Drawing Sheets

(56) References Cited

U.S. PATENT DOCUMENTS

| | | | | |
|---|---|---|---|---|
| 2022/0002976 | A1* | 1/2022 | Fukuoka | E02F 9/267 |
| 2022/0136206 | A1* | 5/2022 | Ishii | E02F 9/0866 180/68.1 |

FOREIGN PATENT DOCUMENTS

| | | | |
|---|---|---|---|
| KR | 10-0312126 | B1 | 12/2001 |
| KR | 10-2021-0103060 | A | 8/2021 |

OTHER PUBLICATIONS

Written Opinion issued on Jul. 11, 2023 for corresponding International Patent Application No. PCT/KR2023/003893 (5 pages).

* cited by examiner

START CONTROL SYSTEM FOR CONSTRUCTION MACHINE, AND CONTROL METHOD THEREOF

CROSS REFERENCE TO RELATED APPLICATION

The present application is a National Stage filing under 35 U.S.C § 371 of PCT application number PCT/KR2023/003893, filed on Mar. 23, 2023, which is based upon and claims the benefit of priority to Korean Patent Application No. 10-2022-0036791, filed on Mar. 24, 2022, in the Korean Intellectual Property Office. All the aforementioned applications are incorporated herein by reference in their entireties.

TECHNICAL FIELD

The present disclosure relates to a start control system for a construction machine and a control method thereof, and more specifically, to a start control system for controlling the start of a construction machine and a control method thereof.

BACKGROUND ART

As smart keys become more popular, a construction machine such as excavators are also equipped with smart key start control systems, allowing users to open doors or turn an engine on/off while carrying a smart key.

A smart key start control system is furnished with a noise blocking circuit, but many noise conditions exist in the work sites of a modern construction machine, and unexpected noise may cause the smart key start control system to malfunction.

When the signal from the smart key is incorrectly transmitted to a start switch due to internal or external noise, the start may suddenly turn on or off without protection logic. In reality, at work sites where a construction machine is being operated, a situations may occur where the engine is turned off during work or traveling of the construction machine due to noise as described above.

Accordingly, it is necessary to provide safe protection logic to prevent the start state from changing even when a worker of a construction machine presses a button incorrectly or noise is generated without causing discomfort.

DETAILED DESCRIPTION OF INVENTION

Technical Problems

An aspect of the present disclosure provides a start control system for a construction machine and a control method thereof, which may prevent a start switch from malfunctioning due to a noise signal generated during work or traveling of the construction machine in which the start is controlled by a smart key or the start switch manipulated by a worker.

Technical Solution

According to an embodiment of the present disclosure, a start control system for a construction machine includes: a work device and a travel device of the construction machine, the work device and travel device being mechanically connected to an engine; a start switch controller which receives a signal input to a start switch and converts the start of the engine to an on state or an off state; and a vehicle control unit which receives information from the work device and the travel device, determines whether the construction machine is working or traveling, and transmits a signal to the start switch controller, wherein, when the vehicle control unit which has determined that the construction machine is working or traveling transmits the signal, the start switch controller determines that the signal input to the start switch is a noise signal and maintains a start state of the construction machine.

In addition, the travel device further includes a transmission control unit that transmits speed information of the construction machine to the vehicle control unit. When a speed of the construction machine is equal to or greater than a set speed, the vehicle control unit determines that the construction machine is working or traveling and transmits a signal of the vehicle control unit to the start switch controller.

In addition, the work device further includes a main pump that supplies an operation oil to work machinery of the construction machine. When a pressure value measured from the main pump is received and a pressure of the main pump is equal to or greater than a set pressure, the vehicle control unit determines that the construction machine is working or traveling and transmits a signal of the vehicle control unit to the start switch controller.

In addition, the travel device further includes a steering pump that supplies an operation oil to a steering device of the construction machine. When a pressure value measured from the steering pump is received and the pressure of the steering pump is equal to or greater than a set pressure, the vehicle control unit determines that the construction machine is working or traveling and transmits a signal of the vehicle control unit to the start switch controller.

In addition, there is further included a pilot cut-off switch that controls cut-off of pilot hydraulic pressure for controlling working or traveling of the construction machine. When the pilot cut-off switch is in an on state, the vehicle control unit determines that the construction machine is working or traveling and transmits a signal of the vehicle control unit to the start switch controller.

In addition, there is further included a pilot pressure sensor that measures a pressure of the pilot hydraulic pressure transmitted to a control valve of work machinery of the construction machine. When a pressure measurement value of the pilot pressure sensor is received, the vehicle control unit determines that the construction machine is working or traveling and transmits the signal of the vehicle control unit to the start switch controller.

In addition, the start switch controller converts a start state of the construction machine when it is identified that a signal input to the start switch is repeated a set number of times for a set time while the construction machine is in a working or traveling state.

In addition, the start switch is disposed on a side surface centered on a user riding in a cabin of the construction machine.

According to another embodiment of the present disclosure, a control method of a start control system for a construction machine includes: a stage in which a signal input to a start switch is transmitted to a start switch controller; a stage in which a vehicle control unit determines a working or traveling state of the construction machine; a stage in which the vehicle control unit transmits a result value of determining the working or traveling state to the start switch controller; and a stage in which the start switch controller determines whether the signal input to the start switch is a noise signal based on the result value transmitted by the vehicle control unit, wherein the stage of determining whether the signal is the noise signal determines that the signal input to the start switch is the noise signal when the construction machine is in the working or traveling state, and maintains a start state of the construction machine.

In addition, prior to the stage of determining the working or traveling state of the construction machine, when the time for which a signal is input to the start switch is less than a set time, there is further included a stage of identifying a start on/off state of the construction machine.

In addition, the stage of determining the working or traveling state of the construction machine includes a stage of determining whether a speed of a vehicle of the construction machine is equal to or greater than a set speed; a stage of determining whether a pressure of a main pump of the construction machine is equal to or greater than a set pressure; and a stage of determining whether a pressure of a steering pump of the construction machine is equal to or greater than a set pressure.

In addition, prior to the stage of determining whether the signal is the noise signal, there is further included a stage of determining whether the signal input to the start switch has been repeated a set number of times for a set time, wherein in the stage of determining whether the signal input to the start switch has been repeated the set number of times for the set time, when the signal has been repeated the set number of times for the set time, the construction machine is determined to be in an emergency situation and the start state of a vehicle of the construction machine is converted.

Specific details of other embodiments are included in the detailed description and drawings.

Effect of Invention

A start control system for a construction machine and a control method thereof according to an embodiment of the present disclosure have the following benefits.

First, it is possible to determine whether a signal input to a start switch is a noise signal. Accordingly, malfunction of the start switch caused by noise signals can be prevented.

Second, by preventing malfunction of the start switch, it is possible to prevent accidents involving the construction machine and casualties.

BEST MODE FOR CARRYING OUT THE INVENTION

Figure 1:
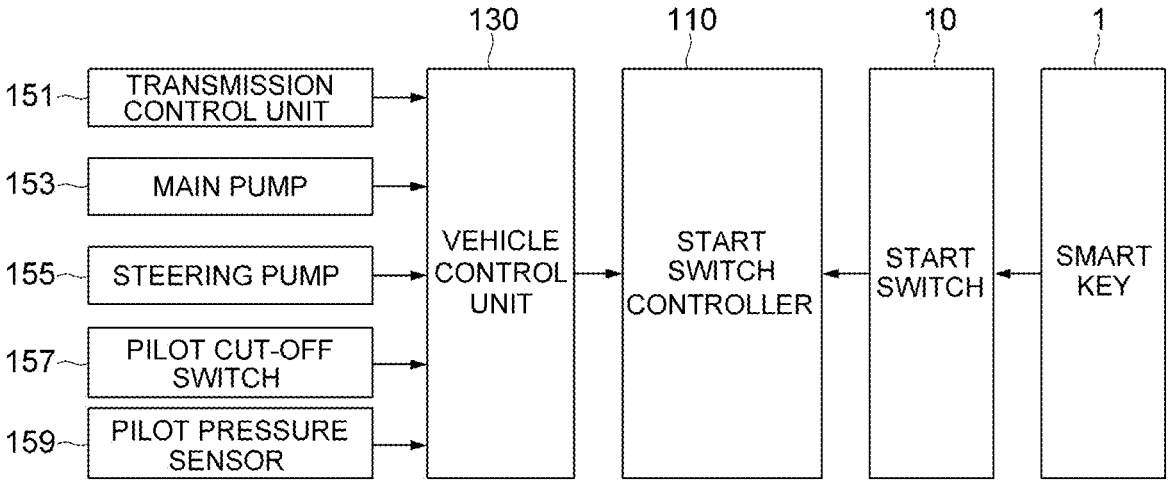
FIG. 1 is a block diagram illustrating the configuration of a start control system for a construction machine according to an embodiment of the present disclosure.

Hereinafter, embodiments of the present disclosure will be described in detail with reference to the accompanying drawings so that those with ordinary skill in the art to which the present disclosure pertains may easily carry out the embodiments. The present disclosure may be implemented in various different ways, and is not limited to the embodiments described herein.

It is noted that the drawings are schematic, and are not illustrated based on actual scales. Relative dimensions and proportions of parts illustrated in the drawings are exaggerated or reduced in size for the purpose of clarity and convenience in the drawings, and any dimension is just illustrative but not restrictive. The same reference numerals designate the same structures, elements or components illustrated in two or more drawings in order to exhibit similar characteristics.

Embodiments of the present disclosure illustrate ideal embodiments of the present disclosure in detail. As a result, various modifications of the drawings are expected. Therefore, the embodiments are not limited to specific forms in regions illustrated in the drawings, and for example, include modifications of forms by the manufacture thereof.

Hereinafter, a start control system for a construction machine and a control method thereof according to an embodiment of the present disclosure will be described with reference to FIGS. 1 to 3.

First, the start control system for the construction machine according to an embodiment of the present disclosure will be described with reference to FIG. 1. The start control system for the construction machine according to an embodiment of the present disclosure includes a work device (not shown), a travel device (not shown), a start switch 10, a start switch controller 110, and a vehicle control unit 130.

The travel device (not shown) includes a transmission, etc., and the work device (not shown) includes a hydraulic pump (main pump, and steering pump). The work device (not shown) and the travel device (not shown) are configured to be mechanically connected to an engine (not shown) and to exchange loads with the engine (not shown).

In other words, when there is a load on the work device (not shown) or the travel device (not shown) of the construction machine, if the engine (not shown) is turned off, an issue of equipment suddenly stopping may occur because a very large load is applied. Accordingly, an embodiment of the present disclosure proposes the start control system for the construction machine that may prevent such issues.

The start switch 10 may receive a signal from a smart key 1 when a worker manipulates the smart key 1, or may input a signal when the worker directly manipulates the start switch 10. The start switch controller 110 receives a signal input to the start switch 10 and turns the start of a vehicle of the construction machine on or off.

The smart key 1 is a FOB type that may turn a vehicle on or off by pressing a button. In addition, the smart key 1 may be an electronic device such as a smart horn.

The vehicle control unit 130 determines a working or traveling state of the construction machine. In addition, a signal corresponding to the determined result value is transmitted to the start switch controller 110. The vehicle control unit 130 transmits the result value to the start switch controller 110 by a CAN signal.

The start control system of the construction machine further includes the following components for the vehicle control unit 130 to determine the working or traveling state of the construction machine.

Referring to FIG. 1, the start control system for the construction machine further includes a transmission control unit 151, a main pump 153, a steering pump 155, a pilot cut-off switch 157, and a pilot pressure sensor 159. In other words, the transmission control unit 151, the main pump 153, the steering pump 155, and the pilot cut-off switch 157 are components for the vehicle control unit 130 to determine the working or traveling state of the construction machine.

The transmission control unit 151 is a member for detecting the speed of the construction machine. The vehicle speed of the construction machine detected by the transmission control unit 151 is transmitted to the vehicle control unit 130.

The vehicle control unit 130 compares the speed of the construction machine transmitted from the transmission control unit 151 with the presently stored set speed. In this connection, when the speed of the construction machine is identified to be equal to or greater than the set speed, the vehicle control unit 130 determines that the construction machine is working or traveling, particularly traveling, and transmits the same to the start switch controller (110).

The main pump 153 is included in the work device of the construction machine. The main pump 153 supplies operation oil to work machinery of the construction machine. The vehicle control unit 130 receives the pressure value of the main pump 153 detected from the main pump 153. The vehicle control unit 130 compares the detected pressure of the main pump 153 with the presently stored set pressure.

In addition, when the detected pressure of the main pump 153 is identified to be equal to or greater than the set pressure, the vehicle control unit 130 determines that the construction machine is working or traveling (in particular, traveling) and transmits the same to the start switch controller 110.

The steering pump 155 is provided to supply hydraulic pressure to steering device of the construction machine. The vehicle control unit 130 receives the pressure value detected from the steering pump 155. The vehicle control unit 155 compares the detected pressure of the steering pump 155 with the presently stored set pressure.

In addition, when the detected pressure of the steering pump 155 is identified to be equal to or greater than the set pressure, the vehicle control unit 130 determines that the construction machine is working or traveling (in particular, traveling) and transmits the same to the start switch controller 110.

The pilot cut-off switch 157 controls a cutoff of the pilot hydraulic pressure that controls the traveling or working of the construction machine. In other words, the pilot cut-off switch 157 may output a manipulation signal to cut off the supply of pilot operation oil. When the pilot cut-off switch 157 is in an on state, the pilot operation oil is supplied to various control valves that are used. When the pilot cut-off switch 157 is in an off state, the pilot operation oil is not supplied to various control valves.

The vehicle control unit 130 receives a signal from the pilot cut-off switch 157 and determines whether the pilot cut-off switch 157 is in an on or off state. In this connection, when the pilot cut-off switch 157 is in an on state, the construction machine is determined to be in a working or traveling state (particularly, a work standby state) and transmitted to the start switch controller 110.

The start control system of the construction machine further includes the pilot pressure sensor 159. When the pilot cut-off switch 157 is in an on state, the pressure of the pilot hydraulic pressure of each control valve is further measured by the pilot pressure sensor 159 to determine the working or traveling state of the construction machine.

Specifically, when it is determined that the pilot cut-off switch 157 is in an on state, the vehicle control unit 130 receives the pressure of the pilot hydraulic pressure of various control valves from the pilot pressure sensor 159. The vehicle control unit 130 may determine that there is a signal from a user to operate the construction machine by measuring the pilot hydraulic pressure with various control valves, and may determine whether actual work is being performed.

When the vehicle control unit 130 determines the working or traveling state of the construction machine, it is not necessary to satisfy all conditions of the transmission control unit 151, the main pump 153, the steering pump 155, and the pilot cut-off switch 157. When any one of the transmission control unit 151, the main pump 153, the steering pump 155 and the pilot cut-off switch 157 is determined to correspond to a pre-stored condition, the vehicle control unit 130 determines that the construction machine is working or traveling. In particular, when the pilot cut-off switch 157 is applied, the pilot pressure sensor 159 is used to determine once again whether the construction machine is working or traveling.

When an input signal is received from the start switch 10 for a set time or longer, the start switch controller 110 receives a signal from the vehicle control unit 130 that determines the working or traveling state of the construction machine. In addition, based on this signal, it is determined whether there is noise in the signal input to the start switch 10. When it is determined that the signal input to the start switch 10 is a noise signal, the start state of the construction machine is maintained in the existing state.

In other words, when the start state of the construction machine was in a start-on state, the start-on state is maintained.

The start switch controller 110 may determine that the signal input from the start switch 10 is not a noise signal even when a signal is received from the vehicle control unit 130 that the construction machine is in a working or traveling state.

Specifically, when the signal input to the start switch 10 is repeated a set number of times for a set time, the start switch controller 110 determines that the signal input from the start switch 10 is not a noise signal even when a signal is received from the vehicle control unit 130 that the construction machine is in a working or traveling state.

In this case, the start switch controller 110 determines that the construction machine is in an emergency situation and changes the start state of the construction machine. In other words, when the start state of the construction machine was in a start-on state, the start state is changed to a start-off state so that the construction machine does not continue to work or travel in an emergency situation.

The start switch 10 is disposed on a side surface centered on a user riding in a cabin (not shown) of the construction machine. The start switch 10 is disposed on the side surface of the user, and thus may be clearly seen by the user and may be pressed at any time in an emergency. Specifically, when the user sits on a seat, the start switch 10 is disposed near the window.

Hereinafter, a control method of the start control system for the construction machine according to an embodiment of the present disclosure will be described with reference to FIGS. 2 and 3.

Figure 2:
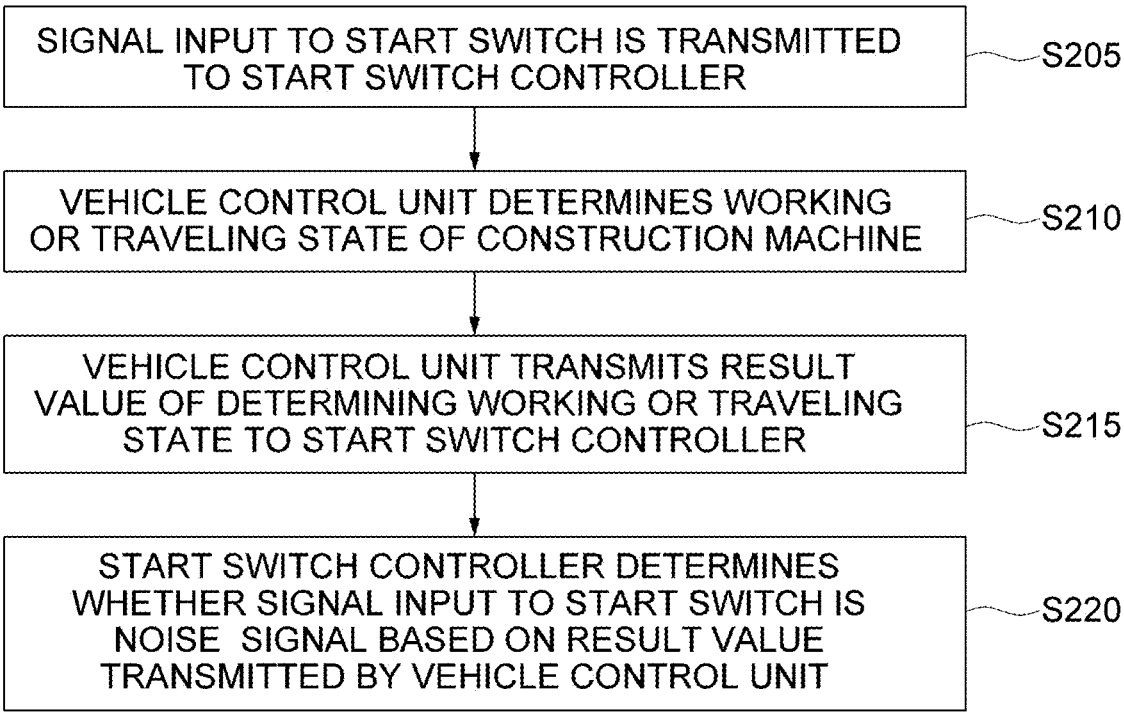
FIG. 2 is a block diagram illustrating a control method of a start control system for a construction machine according to an embodiment of the present disclosure.
Figure 3:
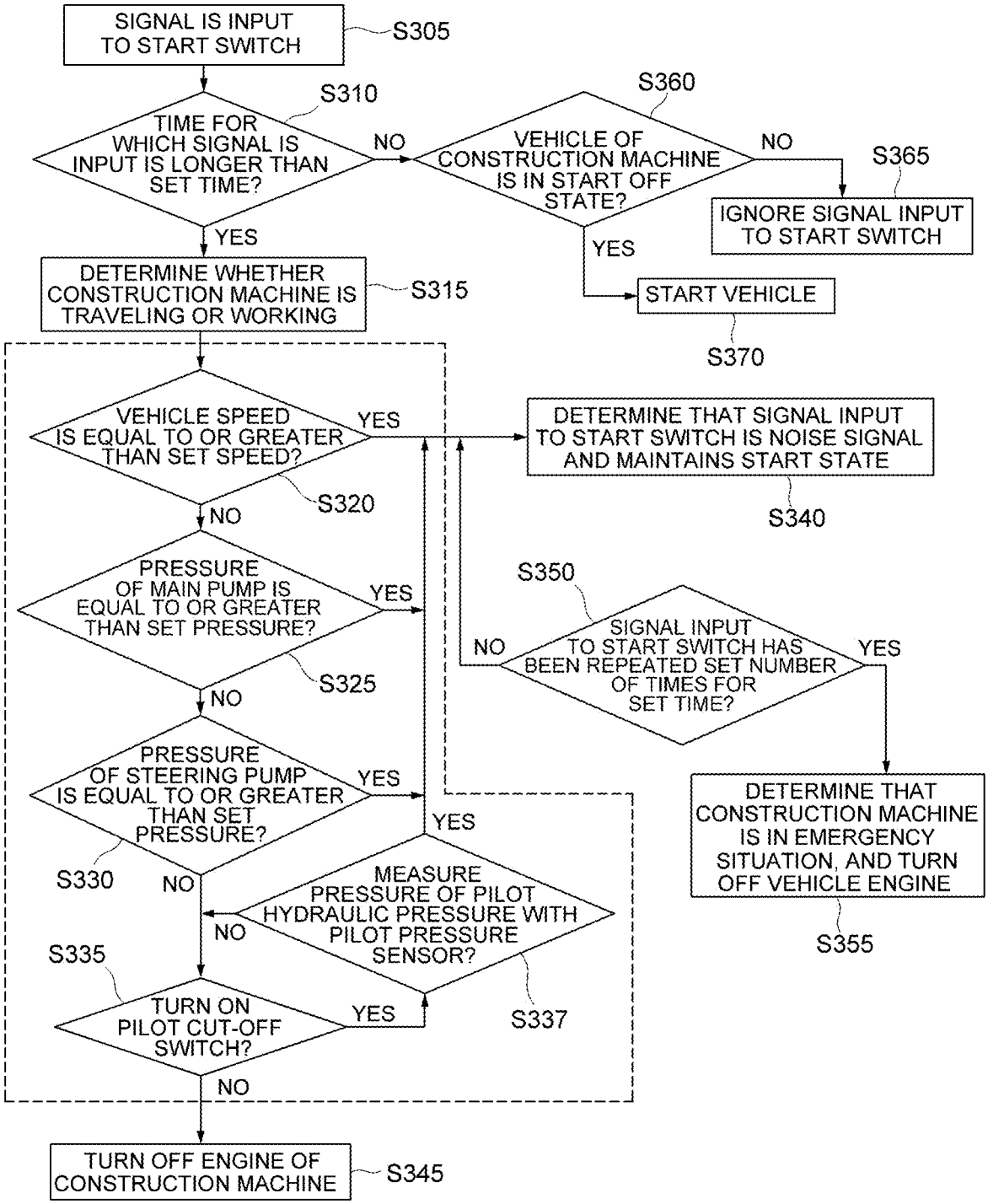
FIG. 3 is a flowchart illustrating a control process by a start control system of a construction machine according to an embodiment of the present disclosure.

As shown in FIG. 2, the control method of the start control system for the construction machine is largely divided into four stages.

First, the signal input to the start switch 10 is transmitted to the start switch controller 110 (stage S205). The signal input to the start switch 10 may be a signal input by a user directly pressing the start switch 10, a signal input by the user transmitting the signal to the start switch 10 via the smart key 1, or a signal input by noise during operation of the construction machine.

Next, the vehicle control unit 130 determines the working or traveling state of the construction machine (stage S210). As described above, the signal transmitted to the start switch controller (110) may be a noise signal, so to determine the same, the working or traveling state of the construction machine is first determined.

When the working or traveling state of the construction machine is determined, the vehicle control unit 130 transmits the result value to the start switch controller 110 (stage S215). Then, the start switch controller 110 determines whether the signal input to the start switch 10 is a noise signal based on the result value transmitted by the vehicle control unit (130) (stage S220).

Hereinafter, the process of controlling according to the control method of the aforementioned start control system is described in more detail with reference to FIG. 3.

A signal is input to the start switch 10 and transmitted to the start switch controller 110 (stage S305). In this connection, it is identified whether the time for which a signal is input to the start switch 10 is longer than the set time (stage S310).

When it is identified that the time for which a signal is input to the start switch 10 in stage S310 above is longer than the set time, the traveling or working state of the construction machine is determined (stage S315). As described above, the traveling or working state of the construction machine is determined based on the detection values received by the vehicle control unit 130 from the transmission control unit 151, the main pump 153, the steering pump 155, and the pilot cut-off switch 157.

To explain more specifically, the vehicle control unit 130 first receives a detection value from the transmission control unit 151 and determines whether the speed of the construction machine detected by the transmission control unit 151 is equal to or greater than a set speed (stage S320). When it is determined that the speed of the construction machine is equal to or greater than the set speed, the vehicle control unit 130 determines that the construction machine is traveling. In addition, the vehicle control unit 130 transmits the determined result value to the start switch controller 110 through a CAN signal.

In addition, the start switch controller 110 determines that the signal input to the start switch 10 and transmitted through this transmitted signal is a noise signal and maintains the start state of the construction machine to its original state (stage S340).

When the speed of the construction machine is determined to be less than the set speed in stage S230 above, it is determined whether the pressure of the main pump 153 is equal to or greater than a set pressure (stage S325). The vehicle control unit 130 compares the pressure value of the main pump 153 with the set pressure, and determines that the construction machine is traveling when it is determined to be equal to or greater than the set pressure. In addition, described above, the vehicle control unit 130 transmits the determined result value to the start switch controller 110 through a CAN signal.

In addition, the start switch controller 110 determines that the signal input and transmitted to the start switch 10 is a noise signal and maintains the start state of the construction machine to its original state (stage S340).

When it is determined in stage S235 above that the pressure of the main pump 153 is less than the set pressure, it is determined whether the pressure of the steering pump 155 is equal to or greater than the set pressure (stage S330). The vehicle control unit 130 compares the pressure value of the steering pump 153 with the set pressure, and determines that the construction machine is traveling when it is determined to be equal to or greater than the set pressure.

In addition, as described above, the vehicle control unit 130 transmits the determined result value to the start switch controller 110 through a CAN signal. Accordingly, the start switch controller 110 determines that the signal input and transmitted to the start switch 10 is a noise signal and maintains the start state of the construction machine to its original state (stage S340).

When it is determined in stage S330 above that the pressure of the steering pump 155 is less than the set pressure, it is determined whether the pilot cut-off switch 157 is in an on state (stage S335). When the vehicle control unit 130 determines that the signal transmitted from the pilot cut-off switch 157 is an on signal, it is determined that the construction machine is in a work standby state.

In this connection, the pilot pressure sensor 159 measures the pilot hydraulic pressure of various control valves to identify whether the pressure of the pilot hydraulic pressure is measured in the control valve (stage S337). At this stage, the vehicle control unit 130 may determine the work standby state of the construction machine through the pressure measurement value measured by the pilot pressure sensor 159, or may determine the work standby state of the construction machine only by whether the pressure of the pilot hydraulic pressure is measured by the pilot pressure sensor 159. Through this stage, it is also possible to verify whether the work standby state of the construction machine was accurately determined in stage S335 above.

In addition, as described above, the vehicle control unit 130 transmits the determined result value to the start switch controller 110 through a CAN signal, and the start switch controller 110 determines that the signal input and transmitted to the start switch 10 is a noise signal and maintains the start state of the construction machine to its original state (stage S340).

When the construction machine is determined to be working or traveling, the start switch controller 110 determines whether the signal input to the start switch 10 has been repeated a set number of times for a set time before maintaining the start state of the construction machine in its original state (stage S350).

When it is determined in stage S350 above that the signal has not been input to the start switch (10) for the set number of times during the set time, the process moves to stage S340 above and maintains the start state of the construction machine in its original state.

However, when it is determined that a signal has been input to the start switch 10 a set number of times for a set time in stage S350 above, the construction machine is determined to be in an emergency situation even when working or traveling, and the start state of the construction machine is converted. In other words, when the start state of the construction machine was in an on state, it is converted to an off state (stage S355).

When it is determined in stage S310 above that the time for which a signal is input to the start switch 10 is not greater than the set time, it is determined whether a vehicle of the construction machine is in a start off state (stage S360).

When it is determined in stage S360 above that the vehicle of the construction machine is not in a start off state, the start switch controller 110 determines that the signal input to the start switch 10 is an error or noise and ignores the signal input to the start switch 10 (stage S365).

When it is determined in stage S360 above that the vehicle of the construction machine is in a start off state, the start switch controller 110 converts the start of the vehicle of the construction machine to an on state according to the signal input to the start switch 10 (stage S370).

As described above, by applying the control system of the construction machine according to an embodiment of the present disclosure, malfunction of the start switch due to noise can be prevented and the start of the construction machine can be prevented from suddenly turning on or off. It is possible to prevent accidents and human casualties caused by sudden turning off or on of the construction machine.

While the embodiments of the present disclosure have been described with reference to the accompanying drawings, those skilled in the art will understand that the present disclosure may be carried out in any other specific form without changing the technical spirit or an essential feature thereof.

Accordingly, it should be understood that the aforementioned embodiments are described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure.

What is claimed is:

1. A start control system for a construction machine, the system comprising:

a work device and a travel device of the construction machine, the work device and travel device being mechanically connected to an engine;

a start switch controller which receives a signal input to a start switch and converts a start of the engine to an on state or an off state; and a vehicle control unit which receives information from the work device and the travel device, determines whether the construction machine is working or traveling, and transmits a signal to the start switch controller, wherein, when the vehicle control unit which has determined that the construction machine is working or traveling transmits the signal, the start switch controller determines that the signal input to the start switch is a noise signal and maintains a start state of the construction machine, and wherein the start switch controller converts the start state of the construction machine when it is identified that the signal input to the start switch is repeated a set number of times for a set time while the construction machine is in a working or traveling state.

2. The system of claim 1, wherein:

the travel device further comprises a transmission control unit that transmits speed information of the construction machine to the vehicle control unit; and when a speed of the construction machine is equal to or greater than a set speed, the vehicle control unit determines that the construction machine is working or traveling and transmits a signal of the vehicle control unit to the start switch controller.

3. The system of claim 1, wherein:

the work device further comprises a main pump that supplies an operation oil to work machinery of the construction machine; and when a pressure value measured from the main pump is received and a pressure of the main pump is equal to or greater than a set pressure, the vehicle control unit determines that the construction machine is working or traveling and transmits a signal of the vehicle control unit to the start switch controller.

4. The system of claim 1, wherein:

the travel device further includes a steering pump that supplies an operation oil to a steering device of the construction machine; and when a pressure value measured from the steering pump is received and a pressure of the steering pump is equal to or greater than a set pressure, the vehicle control unit determines that the construction machine is working or traveling and transmits a signal of the vehicle control unit to the start switch controller.

5. The system of claim 1, further comprising a pilot cut-off switch that controls cut-off of pilot hydraulic pressure for controlling working or traveling of the construction machine, wherein, when the pilot cut-off switch is in an on state, the vehicle control unit determines that the construction machine is working or traveling and transmits a signal of the vehicle control unit to the start switch controller.

6. The system of claim 5, further comprising a pilot pressure sensor that measures a pressure of the pilot hydraulic pressure transmitted to a control valve of work machinery of the construction machine, wherein, when a pressure measurement value of the pilot pressure sensor is received, the vehicle control unit determines that the construction machine is working or traveling and transmits the signal of the vehicle control unit to the start switch controller.

7. The system of claim 1, wherein the start switch is disposed on a side surface centered on a user riding in a cabin of the construction machine.

8. A control method of a start control system for a construction machine, the method comprising:

a stage in which a signal input to a start switch is transmitted to a start switch controller;

a stage in which a vehicle control unit determines a working or traveling state of the construction machine;

a stage in which the vehicle control unit transmits a result value of determining the working or traveling state to the start switch controller;

a stage in which the start switch controller determines whether the signal input to the start switch is a noise signal based on the result value transmitted by the vehicle control unit; and a stage of determining whether the signal input to the start switch has been repeated a set number of times for a set time prior to the stage of determining whether the signal is the noise signal, wherein the stage of determining whether the signal is the noise signal determines that the signal input to the start switch is the noise signal when the construction machine is in the working or traveling state, and maintains a start state of the construction machine, and wherein in the stage of determining whether the signal input to the start switch has been repeated the set number of times for the set time, when the signal has been repeated the set number of times for the set time, the construction machine is determined to be in an emergency situation and the start state of a vehicle of the construction machine is converted.

9. The method of claim 8, further comprising a stage of identifying a start on/off state of the construction machine prior to the stage of determining the working or traveling state of the construction machine when the time for which a signal is input to the start switch is less than a set time.

10. The method of claim 8, wherein the stage of determining the working or traveling state of the construction machine comprises:

a stage of determining whether a speed of a vehicle of the construction machine is equal to or greater than a set speed;

a stage of determining whether a pressure of a main pump of the construction machine is equal to or greater than a set pressure; and a stage of determining whether a pressure of a steering pump of the construction machine is equal to or greater than a set pressure.

* * * * *